United States Patent [19]

Gutschmit

[11] Patent Number: 4,691,873

[45] Date of Patent: Sep. 8, 1987

[54] STRAND STORING AND DELIVERING DEVICE

[76] Inventor: Alan Gutschmit, P.O. Box 708, Troy, N.C. 27371

[21] Appl. No.: 872,210

[22] Filed: Jun. 6, 1986

[51] Int. Cl.[4] ..... B65H 51/20

[52] U.S. Cl. ..... 242/47.01; 242/49

[58] Field of Search ..... 242/47.01, 47.02, 47.03, 242/47.04, 47.05, 47.06, 47.07, 47.08, 47.09, 47.1, 47.11, 47.12, 47.13, 36, 37 R, 49, 28, 29; 66/132 R, 132 T, 163; 139/452

[56] References Cited

U.S. PATENT DOCUMENTS

| | | | |
|---|---|---|---|
| 3,606,975 | 9/1971 | Rosen | 242/47.12 |
| 3,625,444 | 12/1971 | Hatay | 242/47.01 |
| 3,642,219 | 2/1972 | Rosen | 242/47.12 |
| 3,648,939 | 3/1972 | Rosen | 242/47.01 |
| 3,713,307 | 1/1973 | Muhlhausler | 242/47.01 X |
| 3,720,384 | 3/1973 | Rosen | 242/47.01 |
| 3,747,864 | 7/1973 | Rosen | 242/47.01 |
| 3,796,384 | 3/1974 | Rosen | 242/47.12 |
| 3,820,731 | 6/1974 | Rosen | 242/47.12 |
| 3,827,645 | 8/1974 | Rosen | 242/47.12 |
| 3,908,921 | 9/1975 | Jacobsson | 242/47.01 |
| 3,912,185 | 10/1975 | Yamada | 242/47.03 |
| 3,928,987 | 12/1975 | Jacobsson | 242/47.01 X |
| 3,952,554 | 4/1976 | Kerff | 66/163 |
| 3,957,217 | 5/1976 | Clemens | 242/47.01 |
| 4,004,438 | 1/1977 | Raisin | 242/47.01 X |
| 4,106,713 | 8/1978 | Jacobsson | 242/47.01 |
| 4,114,823 | 9/1978 | Fecker et al. | 242/47.01 |
| 4,138,866 | 2/1979 | Fecker et al. | 242/47.01 |
| 4,153,213 | 5/1979 | Jacobsson | 242/47.01 |
| 4,180,215 | 12/1979 | Nurk | 242/47.01 |
| 4,247,057 | 1/1981 | Jacobsson | 242/47.01 |
| 4,271,686 | 6/1981 | Memminger et al. | 242/47.01 X |
| 4,399,952 | 8/1983 | Schaub | 242/47.05 |
| 4,407,336 | 10/1983 | Steiner | 242/47.01 |
| 4,410,146 | 10/1983 | Van Hest | 242/47.01 |
| 4,457,144 | 7/1984 | Sawazaki | 66/132 T |
| 4,481,794 | 11/1984 | Sawazaki | 66/132 T |

FOREIGN PATENT DOCUMENTS

| | | | |
|---|---|---|---|
| 2723965 | 11/1978 | Fed. Rep. of Germany | 242/47.05 |
| 214112 | 10/1984 | Fed. Rep. of Germany | 242/47.01 |

*Primary Examiner*—Stanley N. Gilreath

*Attorney, Agent, or Firm*—Shefte, Pinckney & Sawyer

[57] ABSTRACT

A textile storage feeding device having a pair of spaced upper and lower strand storage drums coaxially mounted integrally with one another and with a driving pulley assembly for integral rotation for transiently storing a traveling textile strand windingly in sequence about the upper storage drum and then about the lower storage drum. A stop motion arm monitors the traveling strand intermediate the storage drums to detect upstream strand breakages, the stop motion arm being isolated from tension variations, flutterings and the like in the traveling strand to avoid "false stops". Another stop motion arm upstream of the storage drums monitors increases in the tension of the strand, without detecting strand breakages or other tension losses, to stop operation in response to excessive strand tension to prevent at least some strand breakages.

23 Claims, 1 Drawing Figure

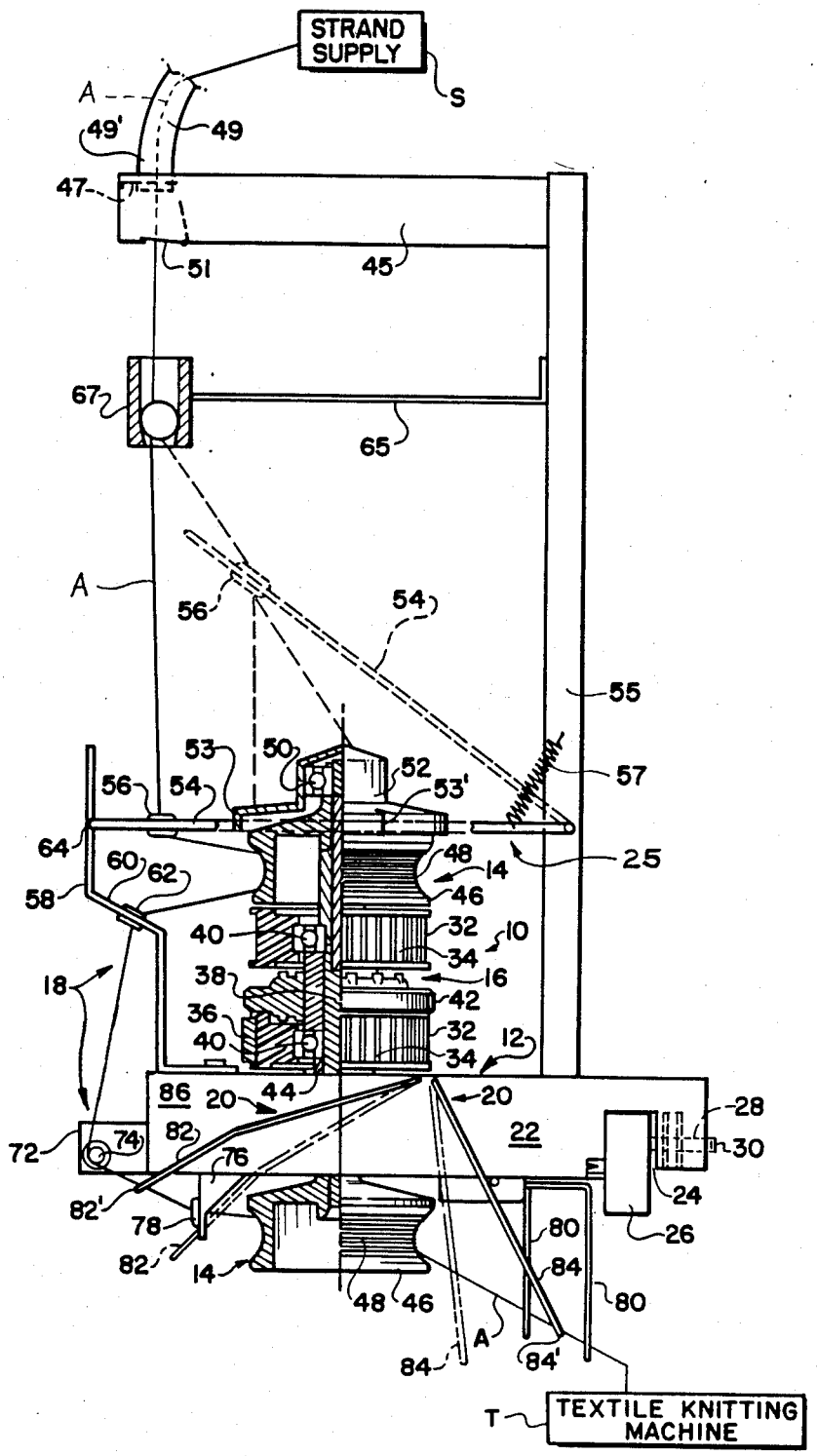
STRAND SUPPLY
S
A
49'
49
47
51
45
67
65
A
56
54
55
53
50
52
53'
57
56
54
64
60
62
48
14
25
58
46
40
32
10
34
18
38
16
42
36
32
40
12
34
86
20
44
20
28
72
74
82
22
30
76
24
82'
78
80
26
82
14
84
48
46
80
A
84
84'
T
TEXTILE KNITTING MACHINE

STRAND STORING AND DELIVERING DEVICE

BACKGROUND OF THE INVENTION

The present invention relates generally to devices for feeding a traveling strand or the like to a textile or like machine and more particularly relates to such devices of the type including a rotatable storage drum or spool adapted to receive several strand windings circumferentially thereabout for transient storage and delivery of a traveling strand by winding and unwinding thereof onto and off the drum or spool.

As used herein, the term "strand" is intended to generically define and indicate any continuous length material such as yarn, thread, filament, wire, rope, cable, tape or the like.

A relatively wide variety of drum or spool devices of the above-described type are well known in the textile industry and are commonly referred to as "storage feeding devices." Representative examples of such storage feeding devices are disclosed in U.S. Pat. Nos. 3,606,975; 3,642,219; 3,648,939; 3,747,864; 3,796,384; 3,827,645; 3,908,921; 3,928,987; 3,952,554; 4,106,713; 4,114,823; 4,138,866; 4,271,686; 4,457,144; and 4,481,794, and in the Democratic Republic of Germany Patentschrift No. 214112. In basic construction, conventional storage feeding devices of the type of the above-listed patents essentially include a strand storage drum or spool for winding thereabout and unwinding therefrom the traveling strand to be stored and fed, with some arrangement being provided to cause the strand windings to move progressively axially on the drum from the on-winding location to the off-winding location. A pulley or similar driving member is fixedly interconnected coaxially with the drum or spool for integral driven rotation by the associated textile or like machine for effecting the on and off winding of the strand in synchronism to the operation of the associated machine.

One of the important purposes served by such storage feeding devices is to continuously maintain transiently a small quantity of the traveling strand so that, in the event of a breakage in the strand between the strand supply and the textile machine, the breakage can be detected by suitable strand monitoring arrangements and the machine can accordingly be stopped before the broken trailing end of the strand is drawn into the textile machine and can no longer be spliced or otherwise rejoined to the leading broken end of the strand from the strand supply. In this regard, conventional storage feeding devices are typically provided with a strand monitoring arrangement, commonly referred to in the industry as a "stop motion," to detect breakages in the traveling strand. In many conventional storage feeding devices, such a stop motion is arranged to monitor the strand upstream of the storage drum and often a second stop motion is provided to monitor the traveling strand downstream of the storage drum as well.

While such stop motions serve the intended purpose of detecting strand breakages and actuating stoppage of the textile machine, it is common for such stop motions to also deactuate the textile machine for no apparent reason when no breakage of the traveling strand has occurred, commonly called "false stops." While it is not fully known and understood why such false stops occur and some disagreement in the industry exists in this regard, it is believed that natural tension fluctuations and flutterings in the traveling strand between the strand supply and the storage feeding device sometimes permit sufficient movement of the upstream stop motion arrangement to cause deactuation of the associated textile machine.

A number of conventional storage feeding devices are provided with spring-biased tension disks or similar strand braking devices through which the traveling strand is trained upstream of the storage feeding device and its stop motions. The above-listed U.S. Pat. Nos. 3,908,921; 3,928,987; 3,952,554; and 4,106,713 disclose representative uses of such tension disk-type braking devices in conventional storage feeding devices. It is believed that such braking devices are utilized essentially only for the purpose of tensioning the strand in the area of the upstream stop motion in order to prevent false stops.

While such braking arrangements to at least some extent aid in reducing the occurrence of false stops, these braking arrangements create additional more serious problems. Ordinarily, the natural tension existing in a traveling textile strand provides as much tension as is necessary for most textile operations. Accordingly, it is considered undesirable to impose additional tension on a traveling textile strand beyond the minimun amount necessary. Tension disks such as those disclosed in the aforementioned patents and other similar braking arrangements create additional strand tension through the imposition of friction thereon, which may deleteriously cause fraying and lint accumulation when used on spun strands and similar fibrous textile strands, as well as occasional strand breakages when the strand tension level becomes too great. Lint production and accumulation only worsen existing environmental problems in many textile mills and furthermore cause quality control problems by increasing the occurrence of strand slubs. At best, the lint accumulation on the braking devices must be periodically removed, sometimes requiring stopping of the associated textile machine with an attendant reduction in the machine production and efficiency.

One solution to the aforementioned problems is disclosed in co-pending U.S. patent application Ser. No. 784,626, filed by the inventor and applicant hereof on Oct. 4, 1985, and entitled "Strand Storing And Delivering Device." Such application discloses an improved storage feeding device having a pair of spaced upper and lower strand storage drums coaxially mounted integrally with one another for synchronous rotation to transiently store windings of a traveling textile strand in sequence about the upper storage drum and then about the lower storage drum. A stop motion arm monitors the traveling strand intermediate the storage drums to detect strand breakages upstream of the storage feeding device, the upper storage drum effectively isolating the stop motion arm from upstream tension variations, flutterings and the like in the traveling strand so that the stop motion arm detects only actual breakages of the strand. In this manner, the storage feeding device substantially eliminates the occurrence of false stops of the associated textile machine without the use of any strand braking device or otherwise imposing additional tension on the traveling strand.

This improved storage feeding device has been found to be highly effective for its intended purpose of avoiding false stops. However, whenever an actual upstream strand breakage occurs, the stored windings of the strand about the upper storage drum must fully deplete before the breakage is detected by the intermediate stop motion arm, which produces the inconvenience to the operator of the associated textile machine upon each such strand breakage of necessarily having to rewind the broken strand about the upper storage drum as well as rethreading the strand through the intermediate stop motion arm and through associated yarn guides.

It is accordingly an object of the present invention to provide an improvement of the aforedescribed dual drum storage feeding device effective to minimize strand breakages occuring upstream of the device while still fully realizing the advantageous effect of the device to substantially eliminate false stops of the associated textile machine.

SUMMARY OF THE INVENTION

The present storage feeding device is basically adapted for transiently storing and delivering a traveling strand to a textile machine, e.g., a circular knitting machine, or the like. Briefly summarized, the present storage feeding device includes rotatable first and second circumferential portions about and from each of which the traveling strand may be wound and unwound and a driving arrangement for rotating the first and second circumferential portions synchronously. A guiding arrangement directs the strand to travel in sequence a plurality of windings about the first circumferential portion and a plurality of windings about the second circumferential portion, with a first stop motion being provided for monitoring the strand intermediate the first and second circumferential portions for detecting breakages in the strand. In this manner, the first stop motion is isolated from tension variations in the strand upstream of the first circumferential portion to detect only actual breakages of said strand without applying any significant increase in tension in the strand. According to the present invention, a second stop motion is also provided for monitoring the strand upstream of the first circumferential portion for detecting tension increases in the strand in excess of a predetermined amount without detecting breakages and other tension decreases in the strand. In this manner, the second stop motion is effective to sense undesirably high upstream strand tension conditions likely to produce a strand breakage, e.g., snagging of the traveling strand at some upstream point from the storage feeding device, and in turn the second stop motion is operative to stop the associated textile machine to permit correction of the strand tension problem, whereby at least some breakages in the strand are prevented altogether.

In the preferred embodiment, the second stop motion includes a strand guide arm for engaging a traveling length of the strand immediately upstream of the first circumferential portion for orienting the strand length with respect thereto. The guide arm is pivotably mounted for movement between a normal operating position wherein the guide arm is in engagement with the strand length at a location axially adjacent the first circumferential portion. In this manner, the guide arm in its normal operating position orients the strand length for generally tangential strand feeding to the first circumferential portion. In the detection position of the guide arm, it orients the strand length generally axially with respect to the first circumferential portion to be uninfluenced by rotation thereof for resisting feeding movement of the strand length toward the first circumferential portion. An arm retaining member is provided for receiving the guide arm in a detent arrangement for holding the guide arm in its normal operating position and for releasing the guide arm under the influence of strand tension increases in excess of the predetermined amount for permitting movement of the guide arm to its detection position. Preferably, a biasing arrangement is provided for urging the guide arm toward its detection position.

Preferably, the strand storage arrangement includes first and second strand storage drums the respective peripheries of which form the circumferential portions, the strand storage drums being integrally affixed in spaced coaxial relation with one another for synchronous rotation. The driving arrangement preferably is a pulley assembly mounted coaxially with the strand storage drums. The guiding arrangement is adapted for feeding the strand generally tangentially to and withdrawing the strand generally tangentially from the circumferential portion of each drum. The first stop motion includes a pivotable arm arranged to rest gravitationally on the traveling length of the strand intermediate the first and second storage drums and to fall gravitationally in response to tension loss in the traveling strand length. A third stop motion is preferably provided for monitoring the strand downstream of the second strand storage drum for detecting breakages in the strand intermediate the storage feeding device and the textile machine.

A cap member is rotatably mounted coaxially with and adjacently upstream of the first strand storage drum for rotation independently thereof, the cap member having a peripheral tooth, flange or the like extending outwardly therefrom to engage the strand and to windingly wrap the strand about the circumferential portion of the first strand storage drum upon rotation of the cap member to facilitate thread-up of the storage feeding device.

BRIEF DESCRIPTION OF THE DRAWING

The accompanying drawing is a side view of the preferred embodiment of the strand storage device of the present invention partially in side elevation and partially in axial section.

DESCRIPTION OF THE PREFERRED EMBODIMENT

Referring now to the accompanying drawing, the storage feeding device of the present invention is generally indicated at 10. The storage feeding device 10 basically includes a support assembly 12 on which a strand storage assembly 14 and a pulley assembly 16 are rotatably mounted for unitary rotation. An arrangement of strand guides, indicated generally at 18, are also mounted on the support assembly 16 to define a strand travel path through the device 10 and a stop motion arrangement, indicated generally at 20, is provided for monitoring the strand to detect breakages. Another stop motion arrangement, indicated generally at 25, is provided for detecting undesired levels of strand tension in excess of a predetermined amount of tension for minimizing the occurrence of strand breakages.

The support assembly 12 includes a longitudinal mounting block 22 having a downwardly open channel 24 formed in the rearward end thereof and adapted to receive an appropriate support member 26 such as a circular support rail or ring typically forming part of the strand feeding and guiding arrangement of a conventional circular knitting machine. A threaded opening 28 is formed through the mounting block 22 to open into the channel 24 and receives an Allen screw 30 for selective clamping of the mounting block 22 horizontally on and unclamping from the support member 26.

The pulley assembly 16 is of the conventional type having a pair of circular pulley wheels 32, each having a plurality of axial teeth 34 formed at spacings in the circumferential periphery thereof to meshingly engage with a toothed drive belt or tape 36 which is employed in a known manner in the strand feeding arrangement of the circular knitting machine. The two pulley wheels 32 are rotatably mounted coaxially adjacent one another on a central support shaft assembly 38 by respective bearing assemblies 40. A clutch disk assembly 42 is rigidly affixed to the support shaft assembly 38 intermediate and coaxially with the pulley wheels 32 and is arranged for axial movement between the two pulley wheels 32 into and out of selective frictional engagement of one or the other thereof to fix the selected pulley wheel 32 in driving relation with the supporting shaft assembly 38. As is conventional, the pulley wheels 32 permit selective driving of the supporting shaft assembly 38 at differing speeds from the quality gear of a conventional textile knitting machine. The supporting shaft assembly 38 extends oppositely beyond each pulley wheel 32, with the lower end of the shaft assembly 38 being rotatably mounted in the mounting block 22 by a bearing assembly 44 fitted in the mounting block 22 to position the shaft assembly 38 in an upright disposition with the pulley assembly 16 directly above the mounting block 22.

The strand storage assembly 14 basically includes a pair of storage drums 46 one of which is rigidly fixed to the projecting lower end of the supporting shaft assembly 38 immediately beneath the mounting block 22 and the other of which is rigidly affixed to the projecting upper end of the supporting shaft assembly 38 immediately above the upper pulley wheel 32. In this manner, the two storage drums 46 are arranged for integral synchronous coaxial rotation with the active pulley wheel 32 which is drivingly connected with the shaft assembly 38 by the clutch disk 42. Each storage drum 46 has a circular periphery 48 of a generally concave shape in axial section to provide a circumferential strand storage portion about and from which a strand may be wound and unwound. The concave periphery 48 of each storage drum 46 is effective to cause strand windings applied thereto at the upper axial end thereof to be deflected axially downwardly along the periphery 48 as the storage drum 46 rotates thereby to tend to maintain a single layer of strand windings about each drum 46, as hereinafter more fully explained. Of course, as those persons skilled in the art will recognize, any conventional storage drum having a suitable circumferential storage portion adapted to transiently store a layer of strand windings thereabout, may also be employed in the present storage feeding device.

The upper projecting end of the shaft assembly 38 includes a terminal stub portion extending upwardly beyond the upper storage drum 46 on which stub portion a bearing assembly 50 is rotatably mounted. A cap member 52 having one or more teeth 53' or similar projections extending slightly from the circumferential edge 53 is frictionally fitted on the bearing assembly 50 for rotational movement relative thereto and particularly relative to the upper storage drum 46 for purposes to be hereinafter more fully described and explained.

An upright support stanchion 55 is affixed in upstanding relation to the upper surface of the mounting block 22 at the end thereof adjacent the mounting channel 24. A support bracket 45 is affixed to the upper end of the stanchion 55 and extends substantially perpendicularly outwardly therefrom directly axially above the strand storage assembly 14. A clamping device, representatively indicated at 47, which may be of any suitable construction, is mounted at the projecting free end of the support bracket 45 for fixedly holding the leading end 49' of a strand transporting tube 49. A slotted slub detector 51 suitable for the particular strand being stored is pivotably mounted to the support bracket 45 immediately beneath the clamping device 47 for movement between an operating position extending transversely intermediate the clamping device 47 and the strand storage assembly 14 as shown in full lines in the drawing for detecting slubs or other undesirably thick portions in a traveling strand as it exits the transporting tube 49 and a thread-up position pivoted upwardly as shown in broken lines for permitting access to the end 49' of the transporting tube 49 for applying a suction threading nozzle or the like to the tube end 49' for drawing a strand through the tube 49 in a conventional manner. Another support arm 65 is affixed to and extends substantially perpendicularly from the support stanchion 55 intermediate the support bracket 45 and the strand storage assembly 14. A ball-type tensioning device representatively indicated at 67, which may be of any suitable conventional construction, may be affixed to the projecting end of the support arm 65 substantially vertically below the end 49' of the tubular conduit 49 and the slub detector 51 in line therewith for use as desirable or necessary to prevent undesirable strand tension losses due, for instance, to strand overfeeding, a ball-type device being preferred for this purpose in that such devices normally do not generate excessive lint and do not require any significant maintenance.

The stop motion arrangement 25 includes a projecting guide arm 54 which is pivotably affixed to and extends from the stanchion 55 toward and beyond the strand storage assembly 14 adjacent the upper end of the upper storage drum 46. The guide arm 54 is configured to extend about the upper storage drum 46 out of engagement therewith and a yarn guide eyelet 56 is fitted in an opening in the projecting outward end of the guide arm 54 opposite the upper drum 46 from the pivoted end of the arm 54. The pivotal mounting of the arm 54 is particularly adapted for permitting movement between a downward operating position extending substantially perpendicularly horizontally from the stanchion 55 radially relative to the upper storage drum 46 wherein the guide eyelet 56 is disposed substantially in line with the yarn transport tube 49 and the ball tensioning device 67 therebelow and generally radially adjacent and slightly above the circumferential periphery 48 of the upper storage drum 46, as shown in full lines in the drawing, and an upward detection position extending at a relatively acute angle relative to the stanchion 55 in an upward direction away from the upper storage drum 46 wherein the guide eyelet 56 is disposed generally axially above the strand storage assembly 14 generally axially adjacent the circumferential periphery 48 of the upper storage drum 46, as shown in broken lines. The guide arm 54 is electrically connected at the location of its pivot mounting to an alarm device, which may be either a light bulb, an audible alarm or the like, to activate the alarm when the guide arm 54 is in its second-described upward detection position. In turn, the alarm device is electrically connected to the associated textile machine to deactivate the machine when the alarm device is triggered by the guide arm 54.

A spring 57, or other suitable biasing device or arrangement, extends between the stanchion 55 and the guide arm 54 for urging the guide arm 54 into its second-described upward detection position. An upright arm 58 is affixed in upstanding relation to the upper surface of the mounting block 22 at the end thereof opposite the mounting channel 24 and includes a bend 60 in the intermediate portion of the arm 58 through which another guide eyelet 62 is fitted. The upper free end of the upright arm 58 is provided with a detent or other recess 64 adapted to receive and retain the extending free end of the guide arm 54 when in its horizontal operating position. The upright arm 58 is adapted to retain the pivoted guide arm 54 engaged in the detent 64 against forces less than a predetermined amount acting on the guide arm 54 in the direction from its downward operating position to its upward detection position (i.e. clockwise as viewed in the drawing), but the upright arm 58 is of sufficient resiliency to release the guide arm 54 in response to greater forces acting on the guide arm 54 in such direction. The upright arm 58 may be selectively constructed to be relatively flexible or relatively stiff as desired to determine the amount of the desired threshold level of force required to release the guide arm 54. As will be understood, the biasing force exerted by the spring 57 provides a degree of force counteracting the retaining force exerted by the upright arm 58 on the guide arm 54 and, according to the present invention, the difference between the guide arm release force required to counteract the retaining force exerted by the upright arm 58 and the biasing force exerted by the spring 57 is selected to equal the maximum amount of tension to which it is desired that a strand stored by the strand storage assembly 14 be subjected. As will be understood, this differential force may be selectively varied by varying the biasing force of the spring 57 or by varying the retaining force of the upright arm 58 or both.

The mounting block 22 includes a leg 72 projecting forwardly from the vertical face of the mounting block 22 at the end thereof opposite the channel 24, with a guide bar 74 of porcelain, polished metal or other smooth surface extending perpendicularly and horizontally from the leg 72. A depending leg 76 projects downwardly from the underside of the mounting block 22 immediately forwardly of the lower storage drum 46 and has a guide eyelet 78 fitted therethrough generally at the level of the upper axial end of the circumferential periphery 48 of the lower drum 46. A pair of U-shaped guide legs 80 are affixed to the underside of the mounting block 22 in parallel aligned spaced relation to one another immediately rearwardly of the lower storage drum 46. While each of the guide eyelets 56,62,78 in the illustrated embodiment are of the conventional annular type, it will be understood that other types of guide eyelets may be employed and, particularly, it is contemplated that spiral or pigtail-type eyelets could be employed to facilitate the ease of the thread-up operation of the device 10 hereinafter more fully described.

The stop motion arrangement 20 includes a first U-shaped arm 82 pivotably mounted to the opposite sides of the mounting block 22 adjacent the upper surface thereof and extending downwardly and forwardly therefrom to dispose the transverse connecting portion 82' of the arm 82 for pivotal movement between an upward position in general alignment between the guide bar 74 and the eyelet 78, as shown in full lines, and a downward position below the level of the eyelet 78, as shown in broken lines. Another U-shaped stop motion arm 84 is similarly pivoted to opposite sides of the mounting block 22 at the upper surface thereof immediately adjacent the pivot location of the arm 82 and extends downwardly and rearwardly therefrom for pivotal movement of the connecting portion 84' of the arm 84 between an upward position intermediate the lower ends of the two U-shaped guide legs 80, as shown in full lines, and a downward position beneath the level of the U-shaped legs 80, as shown in broken lines. In conventional manner, each stop motion arm 82,84 is electrically connected at the location of its respective pivot mounting to an alarm device, which may be either a lightbulb, an audible alarm or the like, to activate the alarm when the respective stop motion arm 82,84 is in its respective lower position. The alarm device is electrically connected in turn to the associated textile machine to deactivate it when the alarm device is triggered by either of the stop motion arms 82,84. In the preferred embodiment, the forward end of the mounting block is formed of a hollow translucent or transparent plastic housing 86 in which a lightbulb of the alarm device is housed to provide a visual indication when the alarm device is activated.

In operation of the strand storage device 10 in a typical embodiment in association with a textile machine such as a circular knitting machine, the device 10 is mounted in a disposition intermediately of a strand supply, indicated only representatively at S, and the knitting or other textile machine, also indicated only representatively at T. In the conventional operation of textile circular knitting machines, the strand A is typically transported from the supply S to the machine T through a tubular conduit such as the conduit 49. Accordingly, the strand storage device 10 is oriented with the support member 45 positioned to receive and clampingly engage the leading end of the strand transporting conduit 49 for receiving the strand A from the supply S in its path of travel to the textile machine T and with the U-shaped guide legs 80 positioned in line to direct the traveling strand to the textile machine T after leaving the device 10. As will be understood, a conventional multi-feed circular knitting machine will employ a respective strand supply for each knitting station whereby a respective plurality of the devices 10 will be employed. The strand A is directed from the tubular conduit 49 through the slub detector 51, the ball tensioning device 67 and the guide eyelet 56; extends therefrom tangentially to and is wound several times circumferentially about the periphery 48 of the upper drum 46; is withdrawn tangentially therefrom forwardly and directed successively through the guide eyelet 62, forwardly about the guide bar 74 and through the guide eyelet 78; extends therefrom tangentially to and is wound several times circumferentially about the periphery 48 of the lower drum 46; and is withdrawn tangentially from the lower drum 46 and directed successively through the two U-shaped guide legs 80.

As will be understood, the ongoing operation of the textile machine T creates an ongoing requirement for additional strand A and, for this purpose, the driving belt 36, which is driven from the textile machine T synchronously therewith in conventional manner, is trained about the periphery of the active one of the pulley wheels 32 selectively engaged by the clutch disk 42 and in proper meshing engagement with the teeth 34 of the selected active pulley wheel 32 of each device 10 being employed. Thus, the active pulley wheel 32 and the upper and lower storage drums 46 of each device 10 are unitarily rotated synchronously with the machine T, whereby the strand A is caused to travel longitudinally from the supply S to the textile machine T during which it is transiently stored in sequence wrappingly about the upper and lower storage drums 46. As the traveling strand A passes through the guide eyelet 56, it is tangentially placed initially onto the periphery 48 of the upper drum 46 adjacent the upper axial end thereof. As integral rotation of the active pulley wheel 32 progresses and in turn rotatably drives the upper storage drum 46, the strand A is wrapped about the upper portion of the periphery 48 of the upper drum 46, but due to the concave axial shape of the periphery 48 and due to the tension existing in the strand A, the strand A is deflected axially downwardly along the periphery 48 toward its central area of reduced diameter and is wrapped thereabout. The wrapping of the strand A thereafter naturally migrates progressively axially downwardly along the periphery 48 of the upper drum 46 under the pushing effect created by the deflection of the following length of the strand A. Similarly, the strand A, upon off-winding from the lower portion of the periphery 48 of the upper drum 46 and direction through the eyelet 62, about the guide bar 74 and through the eyelet 78, is wrapped about and deflected axially along the periphery 48 of the lower drum 46 in identical manner. This manner of strand wrapping deflection and migration occurs progressively as the strand A is continuously fed and wrapped about each drum 46 as the integral rotation of the active pulley wheel 32 and the storage drums 46 continues, thereby to produce a single layer of windings of the strand A about each storage drum 46.

In the initial thread-up of the strand A, each U-shaped stop motion arm 82,84 is pivoted upwardly to its respective upper position to dispose its respective connecting portion 82',84' restingly on the traveling strand A, with the connecting portion 82' resting gravitationally on the extent of the traveling strand A between the guide bar 74 and the eyelet 78 generally in line therewith and the connecting portion 84' resting gravitationally on the extent of the traveling strand A intermediate the two U-shaped guide legs 80 generally in line therewith. In this manner, the stop motion arms 82,84 are maintained pivoted out of their downward positions under the influence of normal strand tension to deactivate the associated alarm and stop motion mechanism and thereby to enable the operation of the machine T to progress normally. On the other hand, as will be understood, upon any significant loss in the tension of the strand A along the extents thereof supporting the stop motion arms 82,84, respectively, sufficient to permit one or the other, or both, of the arms 82,84 to pivot downwardly to its downward position, such as would occur normally in the event of a breakage in the strand A, the stop motion arms 82,84 so pivoting will activate the associated alarm and stop motion arrangement to immediately actuate stoppage of the operation of the machine T. As will be understood, the stop motion arm 82 effectively monitors the traveling strand A to detect breakages or other significant tension losses therein upstream of the lower storage drum 46, while the stop motion arm 84 monitors the strand A to detect breakages or other significant strand tension losses downstream of the lower storage drum 46. In the event of an upstream strand breakage, e.g., between the strand supply S and the upper storage drum 46 along which extent experience shows most strand breakages occur, the stored quantity of the strand A about the upper storage drum 46 will initially deplete and travel to the lower storage drum 46, at which time the stop motion arm 82 will gravitationally pivot to its downward position by virtue of the resultant loss of strand tension to activate the alarm and stop motion arrangement and stop operation of the machine T before any significant depletion of the stored strand A from the lower drum 46 occurs. In the event of a downstream strand breakage, the stop motion arm 84 will almost immediately pivot gravitationally to its downward position to activate the alarm and stop motion arrangement and stop the textile machine T without any significant effect at all on the storage device 10.

Importantly, the provision in the present storage device 10 of both upper and lower storage drums 46 for sequential storage of the traveling strand A in conjunction with the stop motion arm 82 monitoring the strand extent intermediate the two drums 46, effectively isolates the stop motion arm 82 from any tension variations, flutterings or the like occurring along the traveling length of the strand A either upstream or downstream of the storage device 10. Furthermore, the path of traveling movement of the strand A from the upper storage drum 46 to the lower storage drum 46 is closely controlled and constrained by the guide members 62,74,78 so that no similar tension variation, flutterings or the like occur along this traveling extent of the strand A, but without imposing any significant increase in friction or tension on the strand A. Accordingly, the stop motion arm 82 will activate the associated alarm and stop motion arrangement essentially only upon actual breakages in the strand A upstream of the lower storage drum 46. As a result, so-called "false stops" of the machine T, occurring when a stop motion arrangement is activated without the occurrence of an actual strand breakage, are essentially entirely eliminated by the present storage device. Although the precise cause of false stops in conventional storage feeding devices has not been conclusively identified, it is believed that, in conventional storage feeding devices wherein an upper storage drum is not provided, the constant effect of strand tension variations and flutterings continuously produce corresponding fluttering of the upstream stop motion arrangement which occasionally are of sufficient magnitude to activate the stop motion arrangement to stop the machine T although no strand breakage has occurred. In the practical utilization of the present storage feeding device, it has been found that false stops are virtually non-existent and it is believed that this is the result of the arrangement of the two storage feeding drums 46 on opposite sides of the upstream stop motion arm 82 which effectively prevents the aforesaid fluttering and like unintended pivoted movements of the stop motion arm 82 without affecting normal strand tension.

Of course, it will be understood by those persons skilled in the art that it is preferable to minimize as much as possible the occurrence of strand breakages in order to minimize the number of stoppages of the textile machine T and the down time thereof which results from the required correction of the cause of the breakage, rethreading and rewinding of the strand through the storage device 10, and repair of the broken strand. The principal cause of strand breakages is commonly considered in the textile industry to be the result of yarn snags, friction or similar circumstances causing a resistance to normal traveling movement of the strand A and, in turn, producing excessive tensioning in the strand A greater than its tensile strength. The pivoting guide arm 54 of the stop motion arrangement 25 is particularly adapted to monitor the traveling strand A upstream of the strand storage assembly 14 to detect occurrences of strand tension in excess of a predetermined amount of tension indicative of the impending possibility of a strand breakage. Specifically, the aforedescribed differential between the retaining force exerted on the guide arm 54 by the upright arm 58 and the biasing force exerted on the guide arm 54 by the spring 57 is selected according to the present invention to be of a force value substantially equal to the maximum desired amount of tensioning force less than the tensile strength of the strand A to which it may be subjected without significant risk of breakage of the strand A during ordinary feeding of the strand A through the storage feeding device 10. When the tensioning force acting on the strand A upstream of the storage feeding device 14 exceeds this predetermined amount, a potential impending breakage of the strand A is accordingly indicated and, as a result of the selective force differential aforedescribed, the upright arm 58 resiliently releases the guide arm 54 from engagement in the detent 64 to permit the guide arm 54 to pivot to its upward detection position to activate the stop motion arrangement 25, thereby actuating a stoppage of the textile machine T.

As will be understood, at relatively high traveling speeds of the strand A such as typically prevail in the feeding of a strand to a conventional high-speed circular knitting machine, some time lag occurs between the actuation of machine stoppage by the stop motion arrangement 25 and the actual stoppage of the textile machine T during which time the machine T continues to require feeding of the strand A and, in turn, the strand storage assembly 14 of the present device 10 continues to rotationally operate for feeding the required strand A. Advantageously, the guide arm 54 in its upward tension detection position is adapted according to the present invention to isolate the length of the strand A upstream of the strand storage assembly 14 to prevent further feeding movement thereof during the described time lag required for actual machine stoppage. Specifically, as previously described, the guide arm 54 in its upward position orients the strand guide eyelet 56 generally axially above the strand storage assembly 14 generally axially adjacent the circumferential periphery 48 of the upper storage drum 46. In this manner, the length of the strand A extending from the guide eyelet 56 to the periphery 48 of the upper storage drum 46 is oriented substantially axially with respect to the upper storage drum 46 and is therefore not constrained to be wound thereabout as the strand storage assembly 14 continues to rotate during the time lag and, instead, such upstream length of the strand A merely flutters rotationally about the periphery 53 of the cap 52 for the upper storage drum 46. Importantly, the area immediately above and circumferentially about the cap 52 must be open and unoccupied intermediate the cap 52 and the eyelet 56 in the tension detection position of the guide arm 54 so as to permit such strand fluttering to occur unencumbered as the strand storage assembly 14 rotates during the time lag thereby to insure no further tension or other stress is imposed on the strand A. During the continuing rotation of the strand storage assembly 14, the winding of the strand A stored on the upper drum 46 are progressively depleted until the stoppage of the machine T is actually effected. Thus, upon the upward pivotal movement of the guide arm 54, further traveling movement of the strand A upstream of the strand storage assembly 14 is immediately stopped so that no further increase in the strand tension will occur and, accordingly, breakage of the strand A should be prevented if breakage has not already occurred.

The machine operator is required only to locate the cause of the tension increase, e.g. a snag in the strand, correct the tensioning problem, replenish the exhausted windings from the upper storage drum 46 in the convenient manner hereinafter described, and then return the machine T to operation. No rethreading of the strand A through the guiding arrangement and no repairing of a strand breakage is required, so that overall down time of the textile machine T should be considerably reduced. Importantly, the guide arm 54 is entirely unaffected by tension increases less than the predetermined maximum desirable amount of tension, tension decreases, flutterings or the like, occurring along the upstream traveling extent of the strand A so that the operation of the storage feeding device 10 to prevent "false stops" of the textile machine T is unimparied and unaffected. Of course, some degree of actual breakages of the strand A will nevertheless still occur despite the provision of th guide arm 54, in which event the operation of the storage feeding device 10 will be as above-described, but the overall number of actual strand breakages will be substantially reduced.

According to another feature of the present invention, the rotatable cap member 52 provides a convenient manner of winding the strand A about the upper storage drum 46 so as to readily facilitate the replenishment of strand windings about the upper storage drum 46 following tension activation of the stop motion arrangement 25 as well as facilitating the rethreading of the strand A following an upstream strand breakage. As above-explained, in the event of the successful activation of the stop motion arrangement 25 to prevent a potential strand breakage, the guide arm 54 will have pivoted to its upward detection position without any breakage of the strand A having occurred. To replenish any depletion of the strand windings occurring during the subsequent time lag required for actual machine stoppage, it is necessary for the machine operator merely to rotate the cap 52 relative to the strand storage assembly 14 in the rotational direction of strand winding while the guide arm 54 remains in its upward position, whereby the projecting tooth 53' in the cap periphery 53 engages the axially-extending upstream length of the strand A to progressively draw the strand A from its supply S and wind the strand A about the upper storage drum 46 while the downstream length of the strand A is unaffected. Once the upper storage drum 46 has thusly been replenished with a desired number of strand windings, the guide arm is pivoted downwardly into engagement in the detent 64 of the upright arm 58 in the downward normal operating position of the guide arm 54 and the textile machine T is then reactivated.

In the event of an actual upstream strand breakage, the strand A, as above explained, will be depleted from the upper storage drum 46 before the upstream stop motion arm 82 can activate the associated alarm and stop motion arrangement. Accordingly, following each such upstream strand breakage, it is necessary in rethreading the strand A to rewind it about the upper storage drum 46. To accomplish this, the leading broken end of the strand A is threaded initially through the eyelet 56 of the guide arm 54 and therefrom directly through the eyelet 62 in the arm 58, about the guide bar 74 and through the eyelet 78, and is rejoined by a splicing or knotting operation to the broken end of the trailing length of the strand A wrapped about the lower storage drum 46. If the guide arm 54 is not already positioned in its upward detection position, it is then removed from retention in the detent 64 of the upstanding arm 58 and positioned in the upward detection position. Accordingly, the cap member 52 is then manually rotated as above-described a sufficient number of revolutions about the shaft assembly 38 to engage the strand A in the peripheral tooth 53' and wind the strand A about the upper storage drum 46. Once a sufficient number of windings of the strand A have been wrapped about the upper storage drum 46, the projecting end of the guide arm 54 is again positioned in the detent 64 of the upstanding arm 58, whereby the storage device 10 is again ready for operation in the above-described manner. As will be understood, this winding operation of the cap member 52 greatly simplifies and reduces the required time for the necessary replenishment or thread-up of the strand A following any stop motion activation and thereby greatly reduces machine down time occurring during any such machine stoppage, as well as enabling the machine operator to monitor and tend to a greater number of traveling strands.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation it its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A device for transiently storing and delivering a traveling strand to a textile machine or the like, comprising strand storage means having rotatable first and second circumferential portions about and from each of which said strand may be wound and unwound, means for rotatably driving said first and second circumferential portions synchronously, means for guiding said strand to travel in sequence a plurality of windings about said first circumferential portion and a plurality of windings about said second circumferential portion, first stop motion means for monitoring said strand intermediate said first and second circumferential portions for detecting breakages in said strand, whereby said first stop motion means is isolated from tension variations in said strand upstream of said first circumferential portion to detect only actual breakages of said strand, and second stop motion means for monitoring said strand upstream of said first circumferential portion for detecting tension increases in said strand in excess of a predetermined amount without detecting breakages in said strand and other tension decreases in said strand, thereby to prevent at least some breakages in said strand.

2. A strand storing and delivering device according to claim 1 and characterized further in that said second stop motion means comprises means for engaging said strand upstream of said first circumferential portion, said engaging means being releasably constrained in a normal operating position in engagement with said strand in its path of travel upstream of said first circumferential portion to be unaffected by breakages in said strand, other tension decreases in said strand, and tension increases in said strand less than said predetermined amount, and said engaging means being movable to a detection position under the influence of tension increases in said strand in excess of said predetermined amount.

3. A strand storing and delivering device according to claim 2 and characterized further in that said engaging means is arranged in said detection position to engage said strand to dispose a traveling length of said strand immediately upstream of said first circumferential portion to extend generally axially with respect to said first circumferential portion to be uninfluenced by rotation thereof for resisting feeding movement of said strand length toward said first circumferential portion.

4. A strand storing and delivering device according to claim 3 and characterized further in that said engaging means comprises a strand guide arm for engaging said strand length for orienting said strand length with respect to said first circumferential portion, said guide arm being mounted for movement between said normal operating position wherein said guide arm is in engagement with said strand length at a location circumferentially adjacent said first circumferential portion for orienting said strand length for generally tangential feeding thereto and said detection position wherein said guide arm is in engagement with said strand length at a location axially adjacent said first circumferential portion for orienting said strand length generally axially with respect to said first circumferential portion, said second stop motion means further comprising arm retaining means for holding said guide arm in said normal operating position and for releasing said guide arm under the influence of stand tension increases in excess of said predetermined amount for movement to said detection position.

5. A strand storing and delivering device according to claim 4 and characterized further in that said guide arm is pivotably mounted to move between said normal operating position and said detection position.

6. A strand storing and delivering device according to claim 4 and characterized further in that said second stop motion means further comprises means for biasing said arm toward said detection position.

7. A strand storing and delivering device according to claim 4 and characterized further in that said arm retaining means includes detent means for receiving said guide arm in said normal operating position.

8. A strand storing and delivering device according to claim 1 and characterized further in that said first and second circumferential portions are integrally affixed coaxially with one another.

9. A strand storing and delivering device according to claim 1 and characterized further in that each said first and second circumferential portion comprises a circular drum.

10. A strand storing and delivering device according to claim 9 and characterized further in that said drums are integrally affixed in spaced coaxial relation with one another.

11. A strand storing and delivering device according to claim 1 and characterized further in that said guiding means is arranged to feed said strand generally tangentially to, and to withdraw said strand generally tangentially from, each said circumferential portion.

12. A strand storing and delivering device according to claim 8 and characterized further in that said driving means includes pulley means mounted coaxially with said first and second circumferential portions.

13. A strand storing and delivering device according to claim 1 and characterized further in that said first stop motion means includes a movable arm arranged to rest gravitationally on the traveling length of said strand intermediate said first and second circumferential portions and to fall gravitationally in response to tension loss in said traveling strand length.

14. A strand storing and delivering device according to claim 1 and characterized further by third stop motion means for monitoring said strand downstream of said second circumferential portion for detecting breakages in said strand intermediate said device and said textile machine.

15. A strand storing and delivering device according to claim 1 and characterized further by winding means rotatably associated with said first circumferential portion and adapted for receiving said strand and rotatably winding said strand about said first circumferential portion to prepare said first circumferential portion for transient storage of said traveling strand.

16. A strand storing and delivering device according to claim 15 and characterized further in that said winding means includes a cap member mounted coaxially adjacent said first circumferential portion for rotation independently thereof, said cap member having a peripheral projection extending therefrom for engaging said strand and to windingly wrap said strand about said first circumferential portion upon rotation of said cap member.

17. A textile storage feeding device for transiently storing and delivering a traveling textile strand from a strand supply to a knitting machine or like textile machine, comprising first and second strand storage drums having respective circumferential peripheral portions about and from each of which said strand may be wound and unwound, said strand storage drums being integrally affixed in spaced coaxial relation with one another and mounted for synchronous rotation, pulley means mounted coaxially with said strand storage drums for rotatably driving said drums, guide means for feeding said strand generally tangentially to and withdrawing said strand generally tangentially from said circumferential portion of each said strand storage drum for guiding said strand to travel in sequences a plurality of windings about said circumferential portion of said first storage drum and a plurality of windings about said circumferential portion of said second storage drum, first stop motion means for monitoring said strand intermediate said first and second strand storage drums for detecting breakages in said strand, whereby said first stop motion means is isolated from tension variations in said strand upstream of said first strand storage drum to detect only actual breakages of said strand, and second stop motion means for monitoring said strand upstream of said first strand storage drum for detecting tension increases in said strand in excess of a predetermined amount without detecting breakages in said strand and other tension decreases in said strand, thereby to prevent at least some breakages in said strand.

18. A textile storage feeding device according to claim 17 and characterized further in that said second stop motion means comprises a strand guide arm for engaging a traveling length of said strand immediately upstream of said first strand storage drum for orienting said strand length with respect thereto, said guide arm being pivotably mounted for movement between a normal operating position wherein said guide arm is in engagement with said strand length at a location circumferentially adjacent said circumferential portion of said first strand storage drum for orienting said strand length for generally tangential strand feeding thereto and a detection position wherein said guide arm is in engagement with said strand length at a location axially adjacent said circumferential portion of said first strand storage drum for orienting said strand length generally axially with respect to said circumferential portion of said first strand storage drum to be uninfluenced by rotation thereof for resisting feeding movement of said strand length toward said circumferential portion of said first strand storage drum, and arm retaining means for holding said guide arm in said normal operating position and for releasing said guide arm under the influence of strand tension increases in excess of said predetermined amount for movement to said detection position.

19. A textile storage feeding device according to claim 18 and characterized further in that said second stop motion means comprises means for biasing said guide arm toward said detection position, said arm retaining means including detent means for receiving said guide arm in said normal operating position.

20. A textile storage feeding device according to claim 18 and characterized further in that said first stop motion means includes a pivotable arm arranged to rest gravitationally on the traveling length of said strand intermediate said first and second strand storage drums and to fall gravitationally in response to tension loss in said traveling strand length.

21. A textile storage feeding device according to claim 20 and characterized further by third stop motion means for monitoring said strand downstream of said second strand storage drum for detecting breakages in said strand intermediate said device and said textile machine.

22. A textile storage feeding device according to claim 17 and characterized further by winding means rotatably associated with said first strand storage drum and adapted for receiving said strand and rotatably winding said strand about said circumferential portion of said first strand storage drum to prepare said first strand storage drum for transient storage of said traveling strand.

23. A textile storage feeding device according to claim 22 and characterized further in that said winding means includes a cap member mounted coaxially with and adjacently upstream of said first strand storage drum for rotation independently thereof, said cap member having a peripheral tooth extending therefrom to engage said strand to windingly wrap said strand about said circumferential portion of said first strand storage drum upon rotation of said cap member.

* * * * *

UNITED STATES PATENT OFFICE

CERTIFICATE OF CORRECTION

Patent No. 4,691,873 Dated September 8, 1987

Inventor(s) Alan Gutschmit

It is certified that error appears in the above-identified patent and that said Letters Patent are hereby corrected as shown below:

Col. 12, Line 25, delete "unimparied" and insert therefor — unimpaired — .

Col. 5, Line 28, delete "th" and insert therefor — the — .

Col. 15, Line 58, delete "sequences" and insert therefor — sequence — .

Signed and Sealed this

Nineteenth Day of July, 1988

*Attest:*

DONALD J. QUIGG

*Attesting Officer*

*Commissioner of Patents and Trademarks*